US007110686B2

(12) United States Patent
Toyohara

(10) Patent No.: US 7,110,686 B2
(45) Date of Patent: Sep. 19, 2006

(54) IMAGE FORMING APPARATUS CAPABLE OF CHANGING USAGE RATIO AMONG MULTIPLE TONERS

(75) Inventor: Yuichiro Toyohara, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 132 days.

(21) Appl. No.: 10/902,074

(22) Filed: Jul. 30, 2004

(65) Prior Publication Data

US 2005/0058466 A1 Mar. 17, 2005

(30) Foreign Application Priority Data

Jul. 31, 2003 (JP) ..... 2003/204677

(51) Int. Cl.
*G03G 15/00* (2006.01)

(52) U.S. Cl. ..... 399/45

(58) Field of Classification Search ..... 399/45, 399/53, 60, 222, 227, 252, 389, 50, 51
See application file for complete search history.

(56) References Cited

U.S. PATENT DOCUMENTS

| | | | | |
|---|---|---|---|---|
| 5,915,144 | A * | 6/1999 | Ide et al. | 399/45 |
| 6,215,552 | B1 * | 4/2001 | Acquaviva et al. | 356/601 |
| 6,393,229 | B1 | 5/2002 | Toyohara | 399/50 |
| 6,498,910 | B1 | 12/2002 | Haneda | 399/51 |
| 6,591,072 | B1 | 7/2003 | Hashimoto et al. | 399/50 |
| 6,801,727 | B1 * | 10/2004 | Maruyama et al. | 399/45 |
| 2001/0028805 | A1 | 10/2001 | Haneda | 399/51 |

FOREIGN PATENT DOCUMENTS

| | | |
|---|---|---|
| JP | 4-204871 | 7/1992 |
| JP | 5-35038 | 2/1993 |
| JP | 7-26614 | 1/1995 |
| JP | 8-220821 | 8/1996 |
| JP | 2000-231279 | 8/2000 |
| JP | 2001-134146 | 5/2001 |
| JP | 2001-290315 | 10/2001 |
| JP | 2001-318499 | 11/2001 |
| JP | 2001-148893 | 5/2002 |
| JP | 2002-341606 | 11/2002 |

* cited by examiner

*Primary Examiner*—Sandra L. Brase
(74) *Attorney, Agent, or Firm*—Fitzpatrick, Cella, Harper & Scinto

(57) ABSTRACT

An image forming apparatus includes an image bearing member for carrying an electrostatic image; a developing device for developing the electrostatic image with toners having the same hue and having different densities; a toner image formation device for forming a toner image on a recording material; and a fixing device for fixing the toner image on the recording material, wherein a ratio of amounts of toners having the same hue and different densities, which constitute the toner image is changed on the basis of a glossiness of the recording material.

12 Claims, 16 Drawing Sheets

IMAGE FORMING APPARATUS CAPABLE OF CHANGING USAGE RATIO AMONG MULTIPLE TONERS

FIELD OF THE INVENTION AND RELATED ART

The present invention relates to the uniformity, in terms of glossiness, of an image formed by an image forming apparatus operable in the mode in which an image is formed with the use of two or more toners identical in hue and different in color density, and the mode in which an image is not formed with the use of two or more toners identical in hue and different in color density.

Generally, the glossiness of an image formed on a recording medium is affected by the glossiness of the recording medium itself, creating the problem that an image with the glossiness level desired by a user cannot be formed because of the glossiness level of the recording medium itself.

In recent years, a need has been increasing for improving an electrophotographic image forming apparatus in image quality. In other words, a need has been increasing for image forming apparatuses capable of forming an image true to an original or an intended image, not only across the low density areas thereof, but also, across the high density areas thereof. In order to meet such a need, the image forming apparatus disclosed in Japanese Laid-open Patent Application 2002-148893 uses two toners identical in hue and different in color density: toner higher in color density (which hereinafter will be referred to as high color density toner), and toner lower in color density (which hereinafter will be referred to as low color density toner). Further, Japanese Laid-open Patent Application 2001-318499 discloses an image forming apparatus operable in two different modes switchable in accordance with image type: a mode in which both the high color density toner and low color density mode are used, and a mode in which only the high color density toner is used. More specifically, when forming a photographic image for which color density (toner) gradation is of primary concern, the image forming apparatus is operated in the mode in which both the high and low color density toners identical in hue are used, in order to improve the level of color density reproduction. In comparison, when forming a typographical image for which toner gradation is not particularly important, the image forming apparatus is operated in the mode in which only the high color density toner is used, reducing thereby toner usage in order to reduce image formation cost.

However, using only the high color density toner to form a typographical image is problematic in the as an unfixed image on a recording medium is fixed, and a fixed image different in density from the unfixed image is yielded.

In other words, as switching is made between the mode in which both the high color density toner and low color density toner are used, and the mode in which only the high color density toner is used, the problem that as an unfixed image on recording medium is fixed, an fixed image different in density from the unfixed image is yielded because of the difference in image density.

This problem is more conspicuous when a recording medium higher in glossiness level is used.

SUMMARY OF THE INVENTION

Thus, the primary object of the present invention is to provide an image forming apparatus capable of forming an image, the glossiness level of which matches that desired by a user, regardless of the glossiness level of the recording medium used for the image formation.

Another object of the present invention is to solve the problem that as an unfixed image is fixed, the glossiness level of the image becomes different from the original level because of the image density and glossiness level of the recording medium.

Another object of the present invention is to provide an image forming apparatus comprising:

an image bearing member for bearing an electrostatic image;

a developing means capable of developing an electrostatic image using two or more toners identical in hue and different in color density;

a toner image forming means for forming a toner image on recording medium; and a fixing means for fixing the toner image to recording medium, wherein the ratio of usage among the two or more toners identical in hue and different in color density for the toner image formation is adjusted in accordance with the glossiness level of the recording medium used for the image formation.

These and other objects, features, and advantages of the present invention will become more apparent upon consideration of the following description of the preferred embodiments of the present invention, taken in conjunction with the accompanying drawings.

DETAILED DESCRIPTION OF PREFERRED EMBODIMENTS

According to one of the characteristic aspects of the present invention, when forming a toner image using two or more toners identical in hue and different in color density, the ratio of usage among the toners identical in hue and different in color density used for the toner image formation is changed in accordance with the glossiness of level of the recording medium used for the tone image formation. With the employment of this image formation method, it is possible to form an image, the glossiness level of which matches the glossiness level desired by a user, regardless of the glossiness level of the recording medium used for the image formation.

To be described in more detail, various images, except for solid images, formed on recording medium have many areas having no toner. Therefore, the glossiness levels of images formed on recording medium are affected by the glossiness level of the recording medium itself.

Thus, the ratio of usage among two or more toners identical in hue and different in color density used for the formation of a given image is changed in accordance with the glossiness level of the recording medium used for the formation of the given image. With the use of this method, it is possible to adjust the glossiness level of the given image by changing in size the areas of the given image having no toner. Therefore, it is possible to form an image, the glossiness level of which matches the glossiness level desired by a user, regardless of the glossiness level of the recording medium used for the image formation.

According to another characteristic aspect of the present invention, a tone image is formed using two or more toners identical in hue and different in color density, and the ratio of usage among the toners used for image formation is varied depending on the glossiness level of the recording medium used for the image formation, and the density level which an unfixed toner image on the recording medium is expected to achieve as it is fixed. With the use of this method, it is possible to solve the problem that as an unfixed toner image is fixed, the toner image deviates in glossiness level from the target level (desired level) because the glossiness level achieved through fixation is affected by both the image density, and the glossiness level of the recording medium on which the image is formed.

Figure 19:
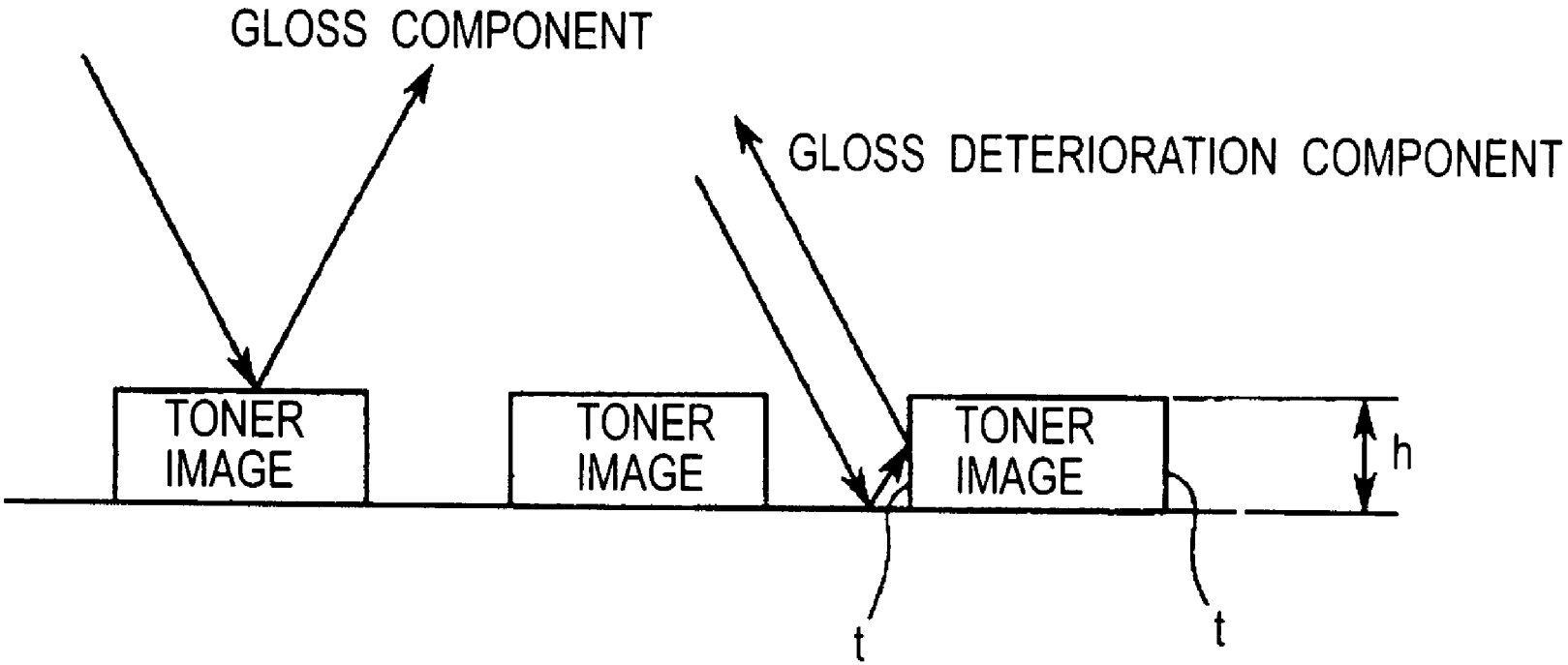
FIG. 19 is a drawing depicting the gradation mechanism which affects the glossiness level.

At this time, referring to FIG. 19, why the glossiness level of an image is affected by the density of an image will be described. When forming an image with a desired level of density, the desired level of density is achieved by adjusting the amount of the toner used per unit area of the recording medium. An image with a desired level of density can be obtained by adjusting the amount of toner to be used per unit area of the recording medium on which the image is to be formed. All images except for solid images have borderline portions (t), each of which is between a given solid area of an image and adjacent areas bearing no toner. This borderline portion (t) does not reflect light in the specific direction. Thus, the longer the borderline portion (t), the less likely light is reflected in the specific direction by an image. More specifically, if a given area of an image is lower in density, its borderline portions (t) are longer, causing the area to reflect the light projected thereupon, in the direction different from the direction in which the light projected upon the surface of the layer of toner is reflected (deflected). Therefore, the area of an image lower in density is lower in glossiness level. In comparison, the area of an image higher in density is shorter in the borderline portion (t), and therefore, is less in the amount of the light reflected (deflected) in the direction different from the direction in which the light projected upon the surface of the layer of the toner is reflected (deflected), being therefore higher in glossiness level. In other words, the glossiness of an image is affected by the image density.

Further, the glossiness of an image is also affected by the glossiness level of the recording medium itself on which the image is formed.

In particular, when forming a toner image on a high gloss recording medium, the effect of the glossiness level of the recording medium itself, on which the toner image is formed, is substantial.

Figure 20:
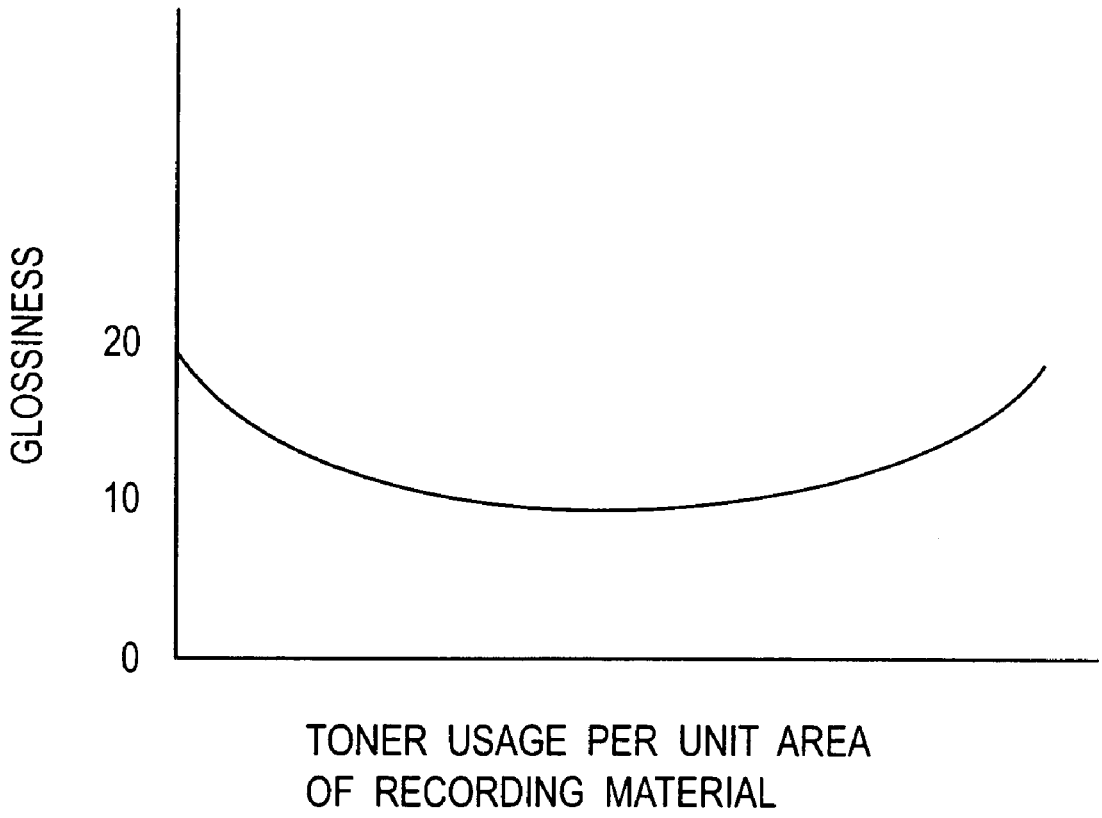
FIG. 20 is a graph showing the relationship between the amount of toner usage per unit area of recording medium, and the glossiness level.

FIG. 20 is a graph showing the relationship between the amount of toner used per unit area of high gloss recording medium, and the glossiness level of the toner image after fixation.

As is evident from FIG. 20, when an image is formed on high gloss recording medium, the area smaller in the amount of toner used per unit area of the recording medium, and the area greater in the amount of the toner used per unit area of the recording medium, are higher in glossiness level than the area medium in the amount of toner used per unit area of the recording medium. The reason why the area greater in the amount of toner used per unit area of the recording medium is higher in glossiness level is that the area is shorter in the length of the borderline portion (t), as described above. The reason why the area smaller in the amount of toner used per unit area of the recording medium is higher in glossiness level is that the area is covered with a smaller amount of toner, and therefore, the glossiness level of the recording medium itself has greater effect upon the glossiness level of the area than the toner thereon. As described above, when forming an toner image on recording medium with a high level of glossiness, the glossiness level of the image considerably varies.

In comparison, when the glossiness level of the recording medium used for image formation is not particularly high, the effect of the glossiness level of the recording medium itself upon the glossiness level of the image formed thereon is inconsequential. Therefore, the area of the image, which is smaller in the amount of the toner used per unit area thereof, is not substantially increased in glossiness level by the glossiness level of the recording medium. Obviously, the area of the image, which is greater in the amount of the toner used per unit area thereof is not increased in glossiness level by the glossiness level of the recording medium. Further, a recording medium lower in glossiness level is not so high in the level of smoothness. Therefore, if the amount of toner placed thereon to form an image thereon is substantial, the surface of the resultant toner layer (toner image) does not become smooth and flat, divergently deflecting (reflecting) the light projected thereon. Thus, even though the borderline portion (t) is shorter because of the substantial amount of toner used per unit area, the glossiness level of the area is not high.

As described above, the glossiness level achieved by an unfixed toner image as it is fixed is affected by image density, and the higher the glossiness level of the recording medium itself, the greater the effect of image density upon the glossiness level achieved by an unfixed image as it is fixed.

Thus, the present invention adjusts the ratio of usage among two or more toners identical in hue and different in color density, based on the glossiness level of the recording medium used for image formation. Therefore, the variance in the amount of toner usage per unit area of the recording medium is smaller among the areas of an image, which are relatively high in density, being therefore relatively large in the amount of tone usage per unit area thereof. Therefore, the variance in the length of the borderline portion (t) is smaller. Therefore, it is possible to reduce the deviation, in the glossiness level of an image, attributable to image density and greater when the glossiness level of the recording medium itself, on which the image is formed, is higher.

Hereinafter, the preferred embodiments of the present invention will be described with reference to the appended drawings.

Incidentally, if a component, a member, a portion, or the like in one of the embodiments has the same referential symbol as one in another embodiment, the two are identical in structure and function. Thus, once they are described, their description will not be repeated.

Embodiment 1

Figure 1:
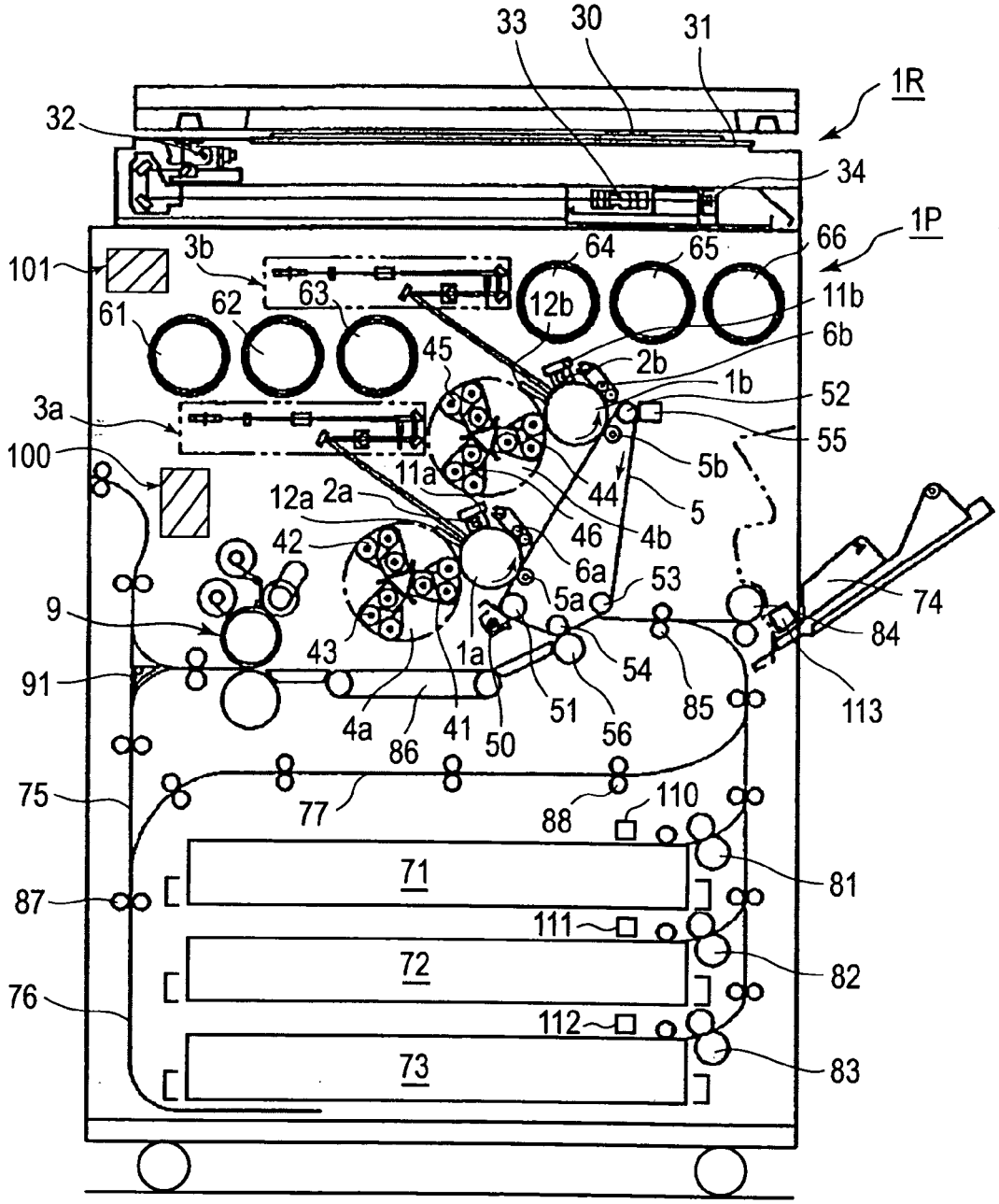
FIG. 1 is a schematic sectional view of the full-color image forming apparatus in the first embodiment of the present invention, depicting the general structure thereof.

FIG. 1 is a schematic sectional view of the electrophotographic full-color image forming apparatus in the first embodiment of the present invention, showing the general structure thereof. The full-color image forming apparatus in this embodiment comprises a digital color image reader 1R, which is located in the top portion of the apparatus, and a digital color image printing station 1P, which is in the bottom portion of the apparatus.

The image forming operation of this apparatus is as follows. That is, an original 30 is placed on the original placement glass platen 31 of the reader portion 1R, and the original 30 is scanned by an exposure lamp 32 so that the light reflected by the original 30 is focused onto the full-color CCD sensor 34 by a lens 33. As a result, video signals representing color components of the original 30 are obtained. These video signals are amplified by an unshown amplification circuit, and then, are sent to an unshown video processing unit, in which the signals are processed. Then, they are sent to the printing station 1P by way of an unshown image formation data storage portion.

To the printing station 1P, not only the signals from the reader portion 1R are sent, but also, the video signals from a computer, video signals from a facsimile machine, etc., are sent.

Here, however, the image forming operation of the image formation station 1P will be described assuming that video signals are sent from the reader portion 1R.

The printing station 1P comprises: a pair of photosensitive drums 1*a* and 1*b* as image bearing members; a pair of pre-exposure lamps 11*a* and 11*b*; a pair of primary charging devices 2*a* and 2*b* of a corona discharge type; a pair of laser based exposure optical systems 3*a* and 3*b*; a pair of potential level sensors 12*a* and 12*b*; a pair of rotaries 4*a* and 4*b* for holding developing apparatuses; and two sets of developing apparatuses (41, 42, and 43) and (44, 45, and 46) different in spectral characteristics and mounted in the rotary; a pair of transferring apparatuses 5*a*, and 5*b*; and a pair of cleaning devices 6*a* and 6*b*. The pair of photosensitive drums 1*a* and 1*b* are rotatably supported so that they can be rotated in the direction indicated in the drawing, and the other components are disposed in the adjacencies of the peripheral surfaces of the photosensitive drums 1*a* and 1*b*, in a manner to surround the photosensitive drums 1*a* and 1*b*.

The developing apparatuses 41–46 are filled with magenta toner (M), cyan toner (C), low color density magenta toner (LM), yellow toner (Y), black toner (K), and low color density cyan toner (LC), respectively. Incidentally, it is possible to equip the image forming apparatus with a developing apparatus containing toner of metallic color, for example, gold or silver color, a developing apparatus containing fluorescent toner, or the like, in addition to the above-mentioned colors.

The developing apparatuses 41–46 in this embodiment contain two-component developer, that is, the mixture of toner and carrier. However, they may contain single-component developer. The employment of such developing apparatuses does not create any problem.

Further, the number of the developing apparatuses employed by the image forming apparatus in this embodiment is six. However, all that is necessary is that the number is no less than four; the number may be any number which is four or greater.

The video signals sent from the reader portion 1R are converted into optical signals by the laser output portion 100 of the laser based exposure optical systems 3*a* and 3*b*. The optical signals, that is, the beams of laser light modulated with the video signals, are deflected (reflected) by the polygon mirror, transmitted through the lens, deflected (reflected) by multiple mirrors, and then, are projected onto the peripheral surfaces of the photosensitive drums 1*a* and 1*b*.

When the printing station 1P is in operation, the photosensitive drum 1 (1*a* and 1*b*) is rotated in the direction indicated by an arrow mark. In terms of the image formation sequence, first, an electrical charge is removed from the peripheral surface of the photosensitive drum 1 (1*a* and 1*b*) is uniformly charged by the primary charging device 2 (2*a* and 2*b*), and is exposed to a beam of laser light modulated with video signals corresponding to one of the color components of the original. As a result, an electrostatic image is formed on the peripheral surface of the photosensitive drum 1 (1*a* and 1*b*). The above-described steps are carried out for each of the color components into which an intended image is separated.

Next, the developing apparatus corresponding in color component to the electrostatic latent image on the photosensitive drum 1 (1*a* and 1*b*) is moved to the developing station by rotating the rotary 4 (4*a* and 4*b*). Then, this developing apparatus is operated to develop the latent image on the peripheral surface of the photosensitive drum 1 (1*a* and 1*b*) into a visible image (image formed of toner composed essentially of resin and pigment).

Since the image forming apparatus in this embodiment is structured as described above, the distances between its exposing stations and corresponding developing stations remain constant regardless of the color of the image being formed, making it unlikely for the monochromatic images different in color to be become different in properties except for color.

Referring to FIG. 1, each developing apparatus is supplied with toner from one of toner storage portions 61–66 (hoppers) with a predetermined timing so that the toner ratio (or amount of toner) in the developing apparatus remains constant. The toner storage portions 61–66 are located next to the laser based exposure optical system 3*a* and 3*b* in terms of the horizontal direction.

The toner image having formed on the photosensitive drum 1 (1*a* and 1*b*) is transferred (primary transfer) onto an intermediary transfer belt 5 as an intermediary transferring member, by the transferring apparatus (5*a* and 5*b*). Since multiple monochromatic images are formed to form a single full-color image, they are transferred in layers onto the intermediary transfer belt 5.

The intermediary transfer belt 5 is stretched around the driver roller 51, follower roller 52, roller 53, and roller 54, and is driven by the driver roller 51. On the opposite side of the intermediary transfer belt 5 from the driver roller 51, a transfer belt cleaning apparatus 50 is located, which can be placed in contact with, or separated from, the intermediary transfer belt 50.

On the opposite side of the intermediary transfer belt 5 from the follower roller 52, a sensor 55 for detecting the positional deviation and color density of the image having been transferred onto the intermediary transfer belt 5 from the photosensitive drum 1 (1*a* and 1*b*) is located, which provides information for continuously adjusting each image formation station in terms of color density, amount of toner supply, image writing timing, image writing start point, etc.

After the necessary number of monochromatic toner images different in color are transferred in layers onto the intermediary transfer belt 5, the transfer belt cleaning apparatus 50 is pressed against the driver roller 51 to remove the toner remaining on the intermediary transfer belt 5 after the transfer of the toner images from the intermediary transfer belt 5 onto recording medium.

Meanwhile, from one of the recording medium storage portions 71, 72, and 73, or a manual feeding portion 74, recording mediums are conveyed, one by one, by one of the recording medium feeding means 81, 82, 83, and 84, respectively, to a pair of registration rollers 85, by which they are straightened if they are askew, and are released with a predetermined timing to be delivered to a secondary transfer station 56, in which the toner images on the intermediary transfer belt 5 are transferred onto one of the recording mediums.

After the toner images are transferred onto the given recording medium in the secondary transfer station 56, the recording medium is conveyed to a fixing apparatus 9 of a thermal roller type by way of a recording medium conveying portion 86. In the fixing apparatus 9, the toner images are fixed, and then, the recording medium is discharged into a delivery tray or a post-processing apparatus.

The surface layer of the heat roller of the fixing apparatus 9 of the image forming apparatus in this embodiment is not formed of rubber. It is such a surface layer that is formed by covering virtually the entirety of the heat roller with a tube formed of fluorinated resin. Providing the heat roller with such a surface layer prolongs the service life of the heat roller, hence, the service life of the fixing apparatus.

In order to assure that the toner layers are not substantially reduced in thickness, the amount of pressure to be applied for fixation by the fixing apparatus 9 is set to a relatively small value.

After the secondary transfer of the toner images, the toner remaining on the intermediary transfer belt 5 is removed by the transfer belt cleaning apparatus 50, and the intermediary transfer belt 5 is used again for the primary transfer process carried out in each of the image formation stations.

The operation for forming an image on both surfaces of a recording medium is as follows. Immediately after the transfer medium is passed through the fixing apparatus 9, the conveyance path guide 91 is driven, temporarily guiding the transfer medium into the reversing path 76 through the recording medium conveyance path 75. Then, the pair of reversing rollers 87 are rotated in reverse, conveying backward the transfer medium, that is, conveying the transfer medium in the direction opposite to the direction in which the transfer medium was guided into the reversing path 76, in other words, the end of the transfer medium, which was trailing when the transfer medium was guided into the reversing path 76, becomes the leading end. As a result, the transfer medium is moved into the two-sided print mode path 77. Thereafter, the transfer medium is conveyed by the pair of two-sided print mode rollers 88 to the aforementioned pair of registration rollers 85 through the two-sided print mode path 77. Then, it is straightened if it is askew, and is released with the predetermined timing, so that an image is transferred through the above-described image formation process, onto the opposite surface of the transfer medium from the surface on which an image has been already formed.

In this embodiment, the glossiness level of the transfer medium on which images are to be formed is detected by the transfer medium glossiness level detecting apparatuses 110–113. Obviously, when the glossiness level of the transfer medium to be used for image formation is known in advance, the glossiness level of the transfer medium may be manually inputted by a user into the apparatus controlling portion 101, without relying on the transfer medium glossiness level detecting apparatuses 110–113, prior to the starting of the image formation.

In other words, in this embodiment, prior to the starting of an image forming operation, the glossiness level of the transfer medium which is to be used for the image formation is determined based on the information provided by the transfer medium glossiness level detecting apparatuses 110–113 with which the transfer medium feeding means 71–74 are provided, respectively. The determined glossiness level of the transfer medium to be used is fed back to the image formation conditions, which will be described next.

With the provision of the above-described arrangement, it is possible to form the optimal image for the transfer medium used for the image formation, without increasing the number of steps which a user must perform.

At this time, the image formation modes of the image forming apparatus in this embodiment will be described.

As described above, this image forming apparatus is provided with two cyan color toners, which are identical in hue and different in color density, that is, cyan color toner higher in color density (which hereinafter may be referred to as "high color density cyan toner") and cyan color toner lower in tone color density (which hereinafter may be referred to as "low color density cyan toner"), and two magenta color toners, which are identical in hue and different in color density, that is, magenta color toner higher in color density (which hereinafter may be referred to as "high color density magenta toner") and magenta color toner lower in color density (which hereinafter may be referred to as "low color density magenta toner").

The statement that two toners are identical in hue, but different in color density, ordinarily means that the two toners are identical in the spectral characteristics of the coloring ingredient contained in the toners composed essentially of resin and coloring ingredient (pigment), but are different in the amount of the coloring ingredient. In other words, the low color density toner means one of the two toners identical in hue, which is lower in color density than the other.

Further, the statement that two toners are identical in hue generally means that the two toners are identical in the spectral characteristics of the coloring ingredient (pigment) they contain. However, it includes the case in which in strict terms, the two toners are not identical in spectral characteristic of the coloring ingredient, but they are identical in terms of the ordinary perception of color, for example, magenta, cyan, yellow, black, etc.

As far as the present invention is concerned, when the two toners are identical in hue and different in color density, the statement that the toner is low in color density (low color density toner) means that when the amount of the toner used per unit area of recording medium is 0.5 mg/cm$^2$, the optical color density of the toner layer formed of this toner is no more than 0.1 after fixation, whereas the statement that the toner is high in color density (high color density toner) means that when the amount of the toner used per unit area of recording medium is 0.5 mg/cm$^2$, the optical color density of the toner layer formed of this toner is no less than 0.1 after fixation.

In this embodiment, the amount of the pigment in the high color density toner has been adjusted so that when the amount of this toner on a recording medium is 0.5 mg/cm$^2$, the optical color density of the toner layer formed of this toner will become 1.6 as the toner layer is fixed, whereas the amount of the pigment in the low color density toner has been adjusted so that when the amount of the toner on a recording medium is 0.5 mg/cm$^2$, the optical color density of the toner layer formed of this toner will become 0.8 as the toner layer is fixed. The high and low color density cyan toners, and high and low color density magenta toners, are skillfully used in combination, to achieve cyan and magenta colors different in tone gradation.

Figure 2:
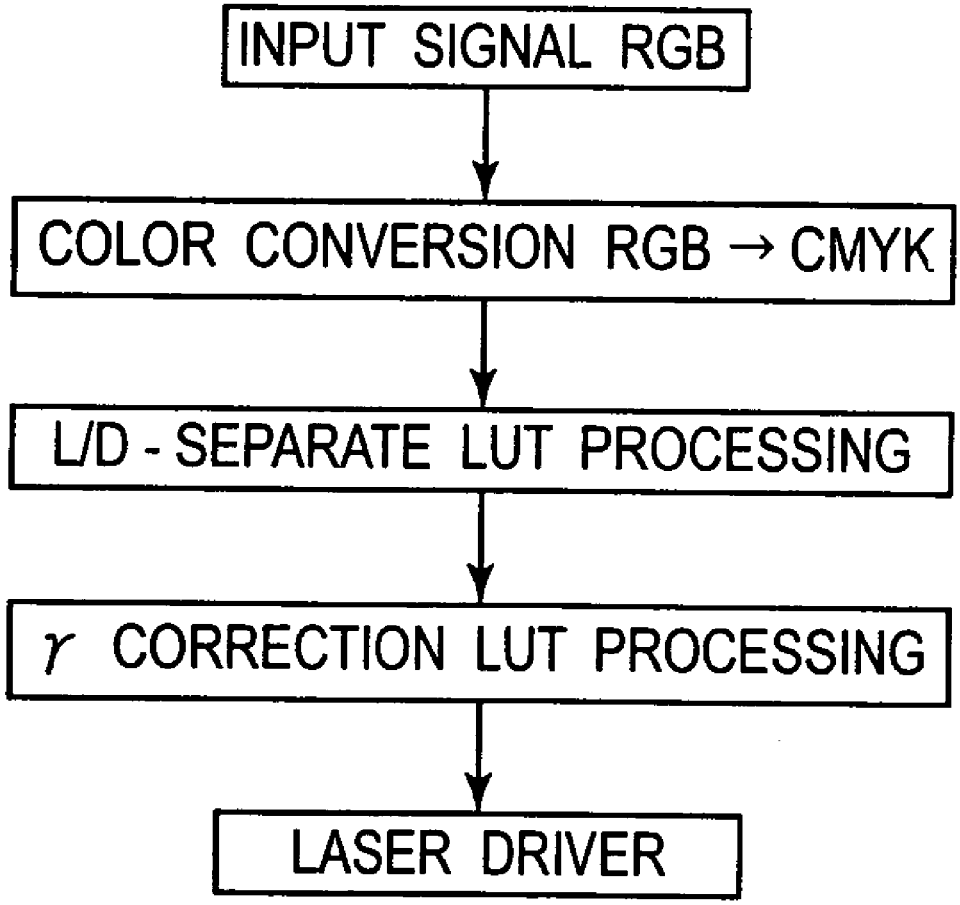
FIG. 2 is a basic flowchart of a method for controlling the image forming apparatus in accordance with the present invention.

Given in FIG. 2 is the basic flowchart followed by the image forming apparatus in this embodiment, for processing video signals.

Referring to FIG. 2, in this embodiment, the inputted video signals corresponding to the color components, such as R, G, B, etc., of an intended image, are converted in color into video signals representing C (cyan), M (magenta), Y (yellow), and K (black) color components. Then, the C, M, Y, and K video signals are separated in color density, based on a look-up table (which hereinafter will be referred to as LUT), such as the one shown in FIG. 3, which will be described later in more detail (high and low color density video signal apportionment LUT process). Thereafter, the video signals representing the high color density and video signals representing the low color density are subjected to their own gamma correction processes, and are used to drive laser drivers in order to output images.

At this time, the image forming operation of the image forming apparatus in this embodiment will be described.

Figure 3:
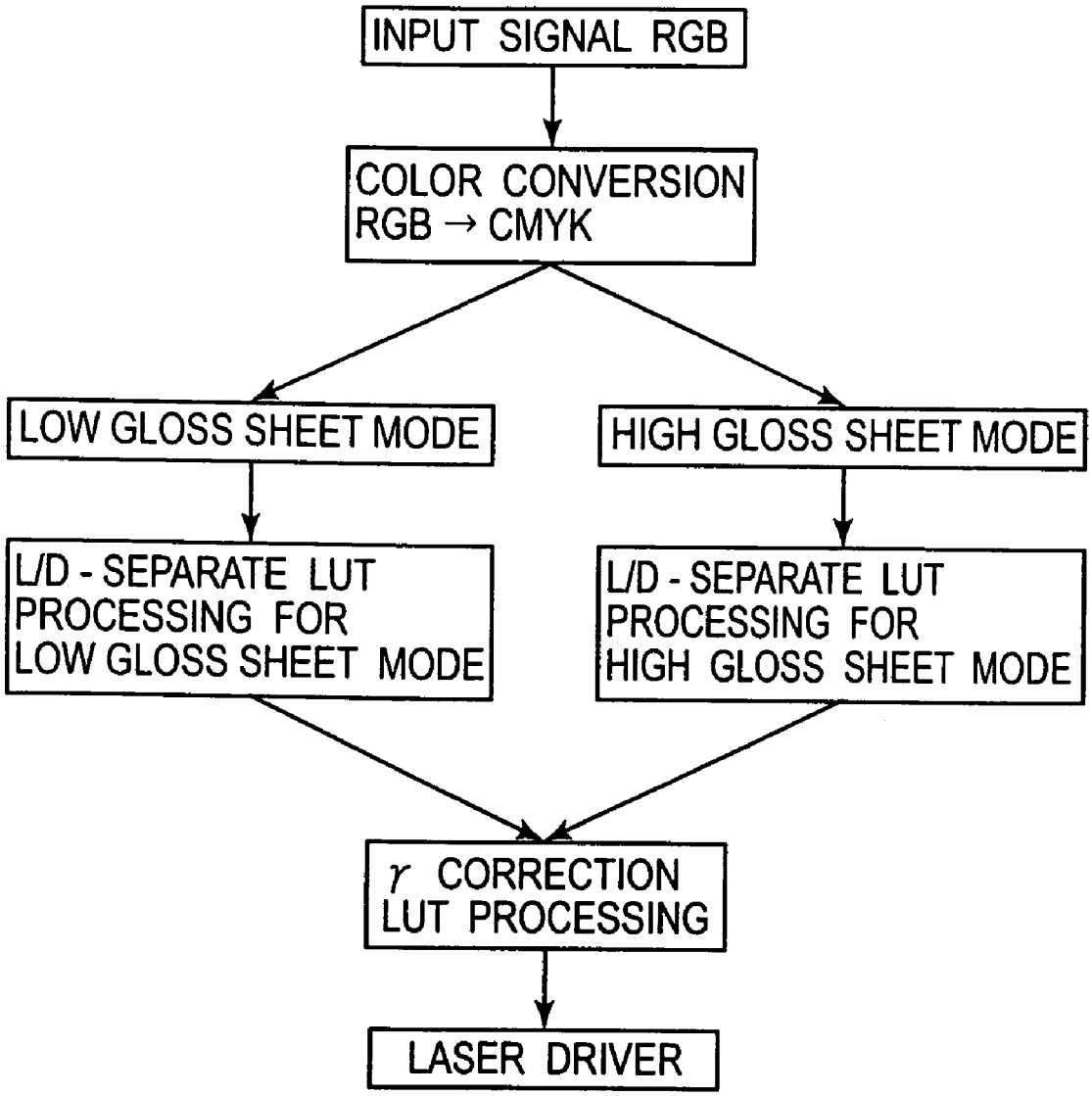
FIG. 3 is a flowchart for the image formation process in the first embodiment of the present invention.

FIG. 3 is the flowchart of the image forming operation of the image forming apparatus in this embodiment. According to this embodiment, the recording papers are separated in two groups in terms of the glossiness level: a low gloss group and a high gloss group. When the recording papers belonging to the low gloss group are used, the image forming apparatus is operated in the low gloss paper mode, whereas when the recording papers belonging to the high gloss group are used, the image forming apparatus is operated in the high gloss paper mode, as shown by the image forming operation control flowchart in FIG. 3. More specifically, the ratio of usage between the two toners identical in hue and different in color density is changed by the laser output portion. In this embodiment, when recording papers, the glossiness level of which is no less than 30, are used, the apparatus is operated in the high gloss paper mode, whereas when recording papers no more than 30 in glossiness level are used, the apparatus is operated in the low gloss paper mode. The switching between the low and high gloss paper modes is made by the laser output portion 110 based on the information provided by the recording medium glossiness level detected apparatuses 110–113. Incidentally, the switching between the low and high gloss paper modes may be made based on the information manually inputted by a user into the apparatus controlling portion.

The low gloss paper mode is provided in anticipation of a case in which an image is formed on low gloss paper, and is used to control the image forming apparatus so that optimal balance is realized between the glossiness level of a copy to be yielded, and the cost for forming the copy. In this mode, only the high color density toner (ratio of high color density toner is 100%; ratio of low color density toner is 0%) is used, and the amount by which the high color density toner is to be deposited on the recording paper is determined with reference to such a lookup table as the one in FIG. 4.

Figure 5:
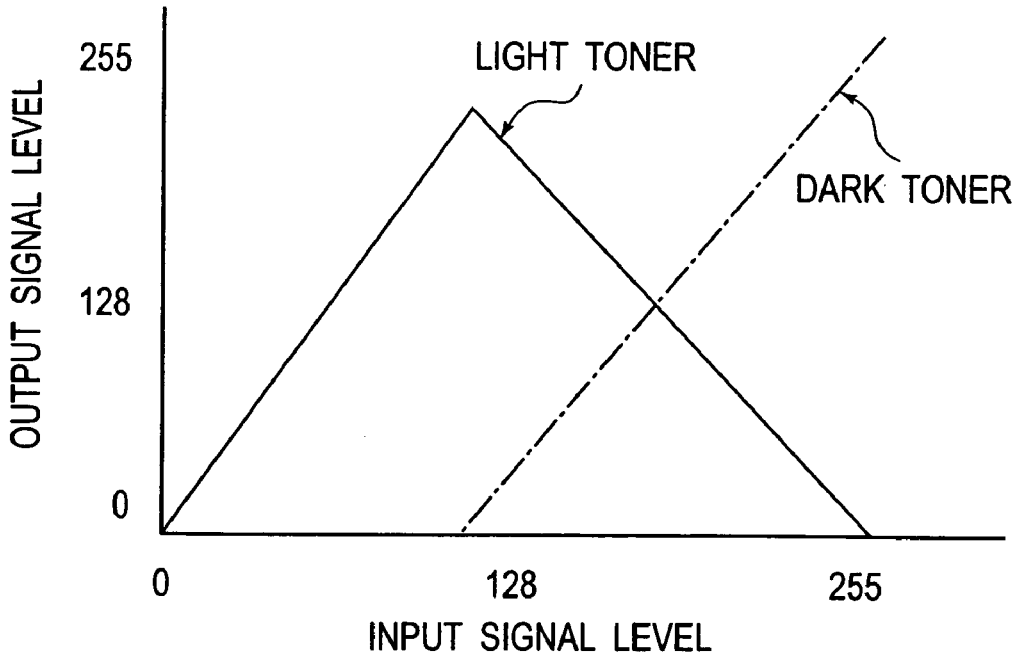
FIG. 5 is a graph showing the pattern of the look-up table (LUT) for the high gloss paper mode.

In the high gloss paper mode, both the high and low color density toners are used, and the amounts by which the high and low color density toners are to be placed on the recording paper are determined with reference to such a LUT as the one shown in FIG. 5.

Figure 6:
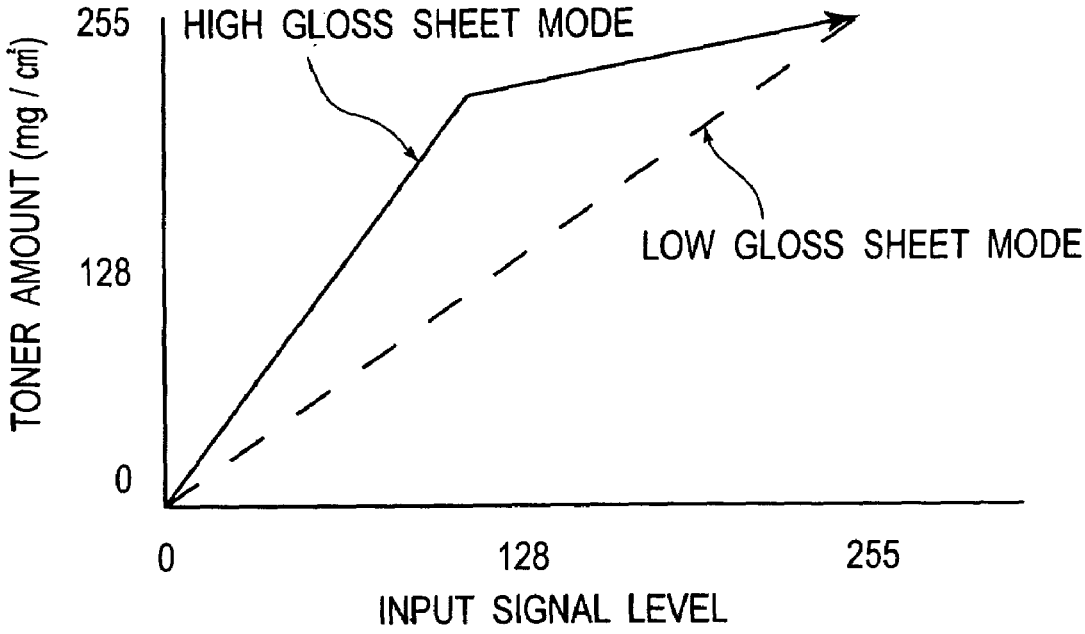
FIG. 6 is a graph showing relationships between the sum of the high and low color density toners placed on recording medium, and input signal level, in the high and low gloss paper modes, in the first embodiment.

FIG. 6 shows the relationship between the sum of the amounts by which the high and low color density toners are to be used, respectively, and the input signal level, after the adjustment of the ratio between the high and low color density toners to be used for image formation (which hereinafter may be referred to simply as toner usage apportionment). In the high gloss paper mode, the low color density toner is used in addition to the high color density toner as shown in FIG. 5. Therefore, the variance, in the total amount of the toner to be used, across the input signal level range, in FIG. 6, is smaller in the section of the range in which the image density is higher.

Figure 7:
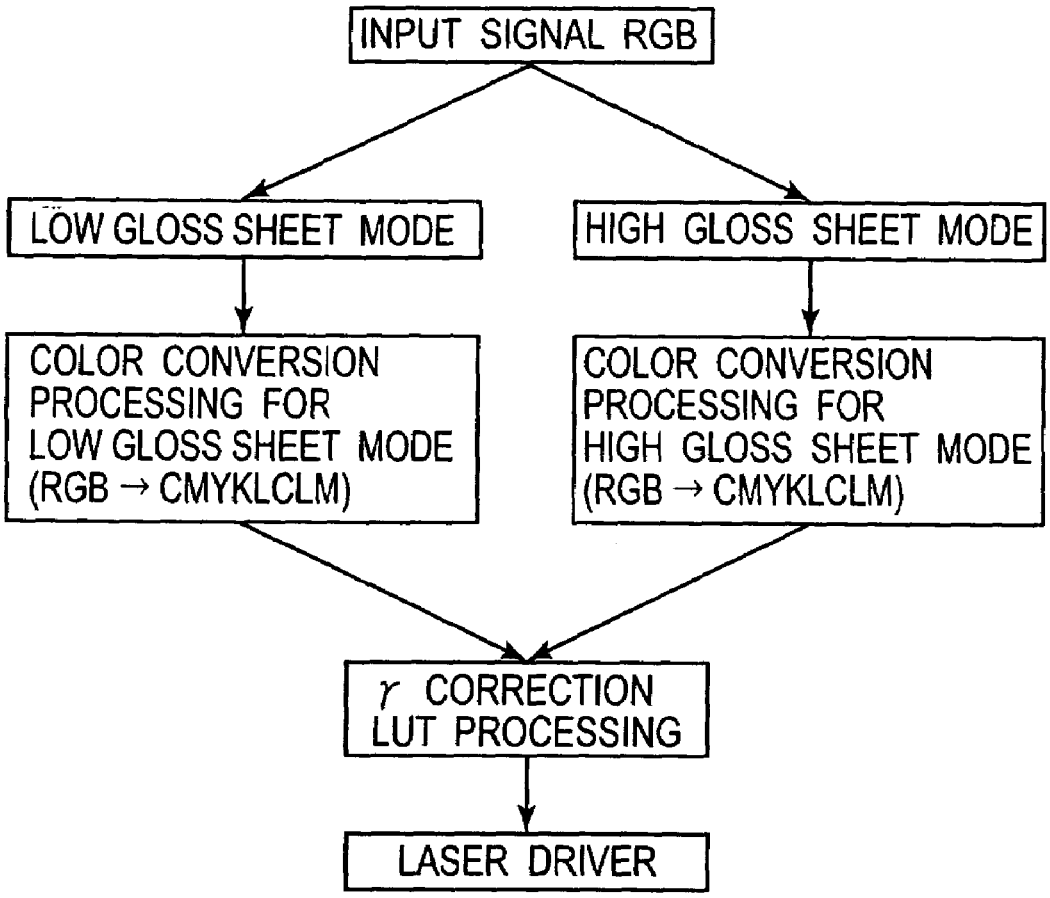
FIG. 7 is a flowchart for the image forming process in another embodiment of the present invention.

The above-described color conversion process and toner usage apportionment (LUT process) may be replaced with the direct mapping process represented by the flowchart shown in FIG. 7. In this case, the difference between the low gloss paper mode and high gloss paper mode is the same as the one described above. This direct mapping process is such a process that directly converts the RGB inputs into six colors, or the C (cyan), M (magenta), Y (yellow), K (black), LC (low color density cyan), LM (low color density magenta). Further, the mapping process is changed according to the print mode; the image forming apparatus is designed so that when the apparatus is in the low gloss paper mode, the amount of the low color density toner used for image formation is greater than when the apparatus is in the high gloss paper mode. In other words, the higher the glossiness level of the recording medium, the greater the amount of the low color density toner used for image formation.

As described above, according to the present invention, the toner usage is properly apportioned between the high and low color density toners, based on the information provided by the apparatus for detecting the glossiness level of the transfer medium to be used for image formation, or the instruction given by a user. Therefore, it is possible to obtain an image having the glossiness level desired by a user, regardless of the glossiness level of the recording medium used for the image formation. In addition, it is possible to reduce the deviation in glossiness level which occurs because of the variance in image density when using high gloss recording medium.

Figure 8:
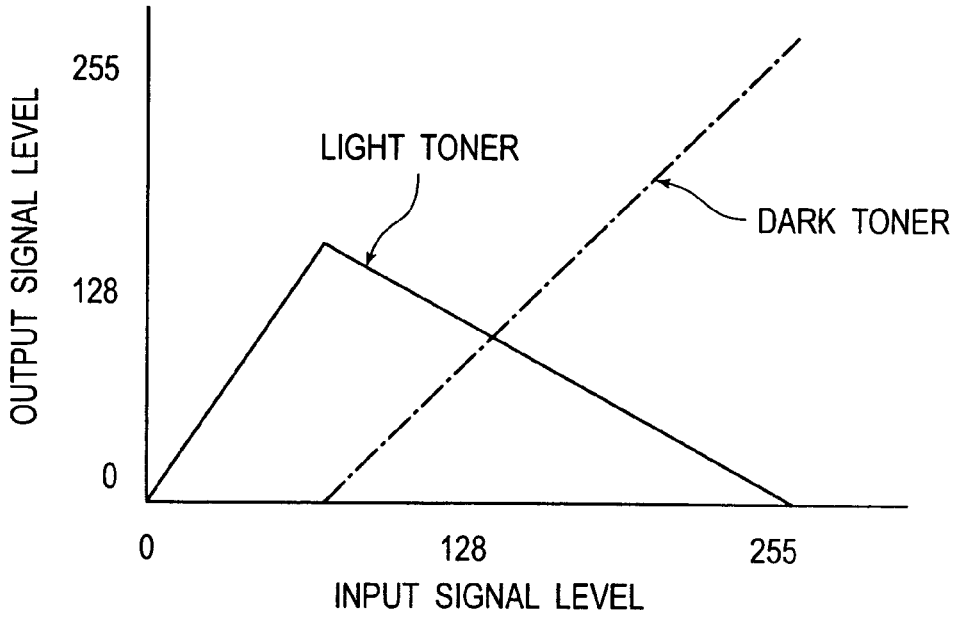
FIG. 8 is a graph showing the pattern of the look-up table (LUT) for the medium gloss paper mode in the first embodiment.
Figure 9:
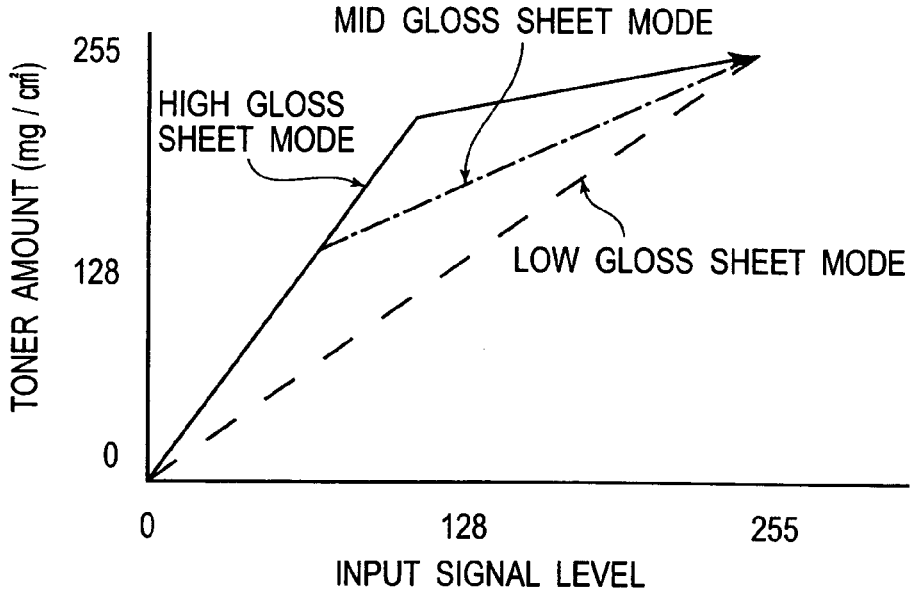
FIG. 9 is a graph showing relationships between the sum of the high and low color density toners placed on recording medium, and input signal level, in the high and low gloss paper modes, as well as in the medium gloss paper mode, in the first embodiment.

Further, the image forming apparatus in this embodiment can be structured so that it can also be operated in the medium gloss paper mode, in which the apparatus is to be used when recording medium with a medium glossiness level is used. In the medium gloss paper mode, both the high and low color density toners are used, and the look-up table used for apportioning of toner usage between the high and low color density toners is such a LUT as the one shown in FIG. 8. The total amount of toner usage in the medium gloss paper mode is smaller than that in the high gloss paper mode. FIG. 9 shows the comparison among the low, medium, and high gloss paper modes, in terms of the relationship between the amounts by which toner is placed on recording medium, and the image density represented by the input signal level. In this embodiment, when the recording mediums used for image formation is no more than 20 in glossiness level, the low gloss paper mode is used, and when they are no less than 20 and no more than 40, the medium gloss paper mode is used. Further, when they are no less than 40, the high gloss paper mode is used.

The laser output portion sets the paper mode from among the low, medium, and high gloss paper modes, based on the information provided by the recording medium glossiness level detecting apparatuses 110–113. Incidentally, the laser output portion is also enabled to select one among the low, medium and high gloss paper modes, based on the information manually inputted by a user into the apparatus control portion.

Figure 10:
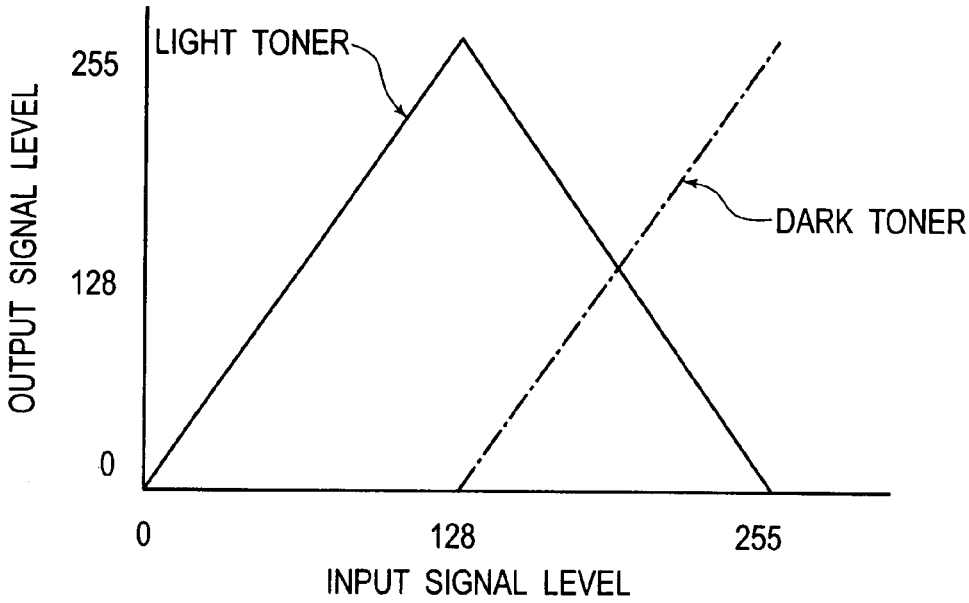
FIG. 10 is a graph showing the pattern of another look-up table (LUT) for the high gloss paper mode in the first embodiment.
Figure 11:
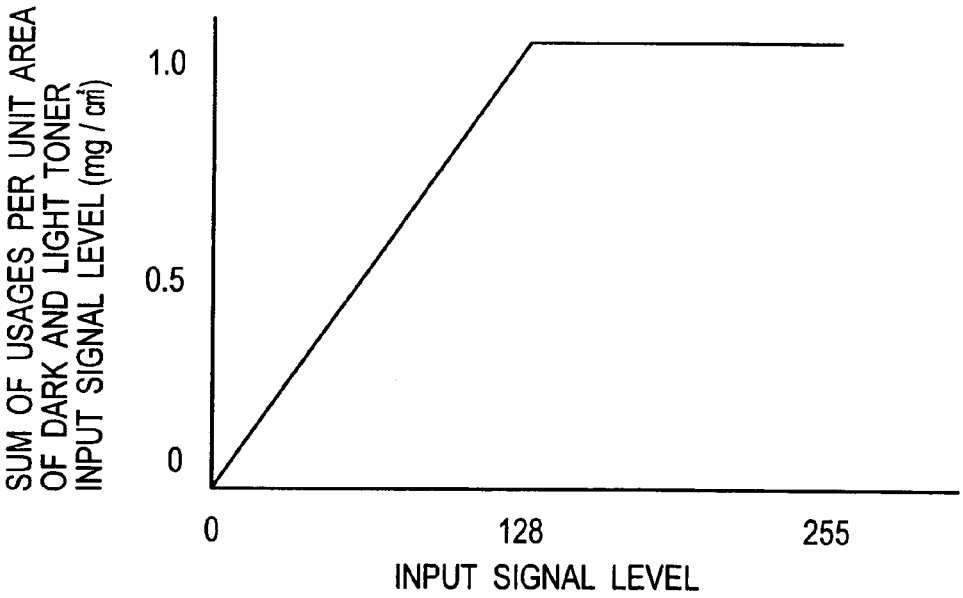
FIG. 11 is a graph showing the relationships between the sum of the high and low color density toners placed on recording medium, and input signal level, in the high gloss paper mode, in which another lookup table is used, in the first embodiment.

Incidentally, in the high gloss paper mode, it is possible to use the LUT shown in FIG. 10. When the LUT shown in FIG. 10 is used, the total amount by which the high and low color density toners are placed on the recording medium in response to a given input signal is roughly the same across the portion of the input signal level range, in which the input signal level is no less than 128. Therefore, when the LUT shown in FIG. 10 is used, the variance in the glossiness level in the area of an image, which is high in density, is smaller than that when the LUT shown in FIG. 8 is used.

In this embodiment, two toners (high and low color density toners) identical in hue and different in color density are used. However, it is possible to use three or more toners identical in hue and different in color density.

An image forming apparatus which uses six toners different in hue or color density is shown in FIG. 1. The six toners are yellow toner, magenta toner, black toner, high color density cyan toner, low color density cyan toner, and super low color density cyan toner; in other words, the three toners among these six toners are cyan toners different in color density. The high color density cyan toner is adjusted in the amount of the pigment so that when the amount of this toner deposited per unit area of recording medium is 0.5 $mg/cm^2$, the optical color density level of the toner layer (toner image) formed of this toner will become 1.6 as the toner layer is fixed. The low color density cyan toner is adjusted in the amount of the pigment so that when the amount of this toner deposited per unit area of recording medium is 0.5 $mg/cm^2$, the optical color density level of the toner layer (toner image) formed of this toner will become 0.8 as the toner image is fixed. Further, the super low color density cyan toner is adjusted in the amount of the pigment so that when the amount of this toner deposited per unit area of recording medium is 0.5 $mg/cm^2$, the optical color density level of the toner layer (toner image) formed of this toner will become 0.4 as the toner layer is fixed.

In the developing apparatuses 41–46 of this image forming apparatus, magenta toner, high color density cyan toner, super low color density cyan toner, yellow toner, black toner, and low color density cyan toner, are stored, respectively. The image forming method employed by this image forming apparatus shown in FIG. 1 when its six developing apparatuses are filled with the above-listed toners, one for one, is the same as the one employed when the six developing apparatuses of this image forming apparatus are filled with yellow toner, cyan toner, magenta toner, black toner, high color density cyan toner, and low color density magenta toner, one for one.

Figure 12:
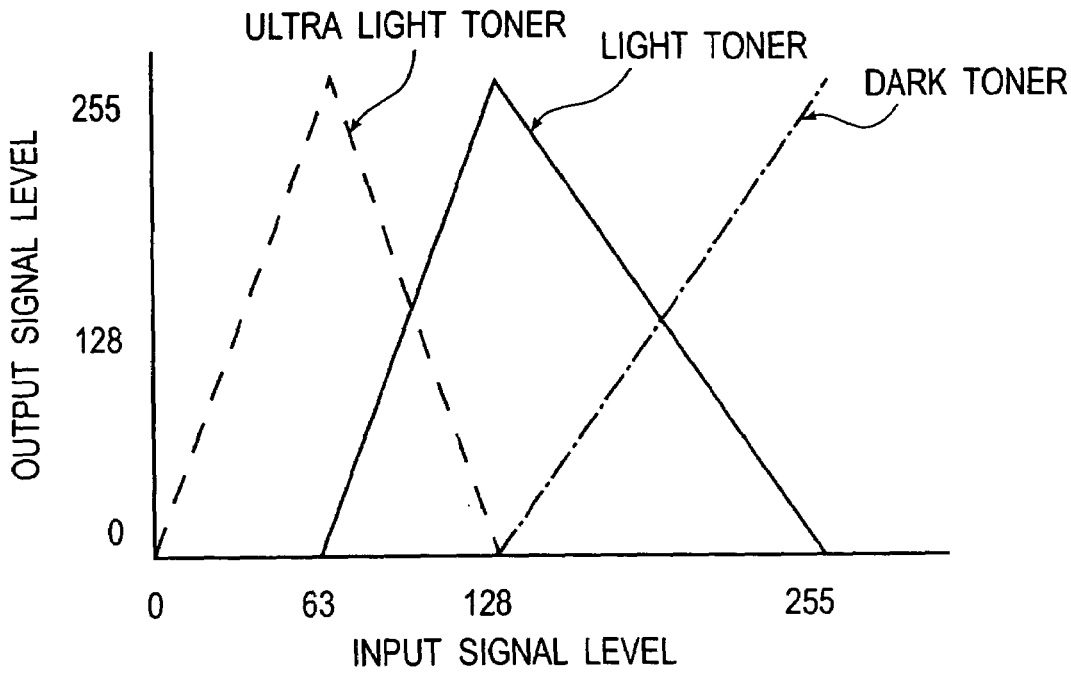
FIG. 12 is a graph showing the pattern of the look-up table (LUT) for the high gloss paper mode in which three toners identical in hue and different in color density are used.
Figure 13:
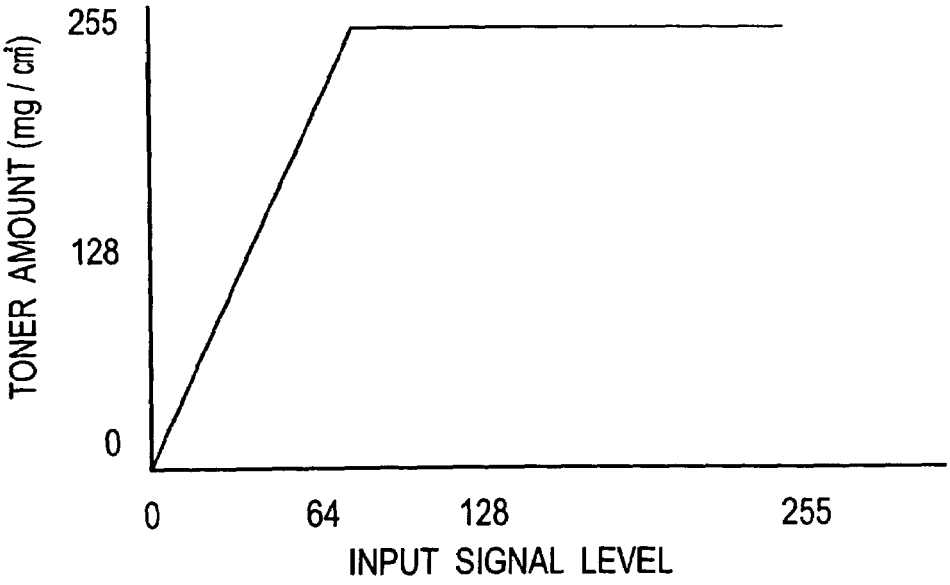
FIG. 13 is a graph showing the relationship between the sum of the high color density toner and low color density toners deposited on the recording medium, and the input signal level, when the lookup table in FIG. 12 was used.

FIG. 12 shows the lookup table used when the image forming apparatus which uses three cyan toners different in color density is used in the high gloss paper mode.

When the lookup table in FIG. 12 is used, the total amount of the toners deposited per unit area of the recording medium in response to input signals is roughly the same across the portion of the input signal level range, in which the input signal level is no less than 64.

Embodiment 2

Figure 14:
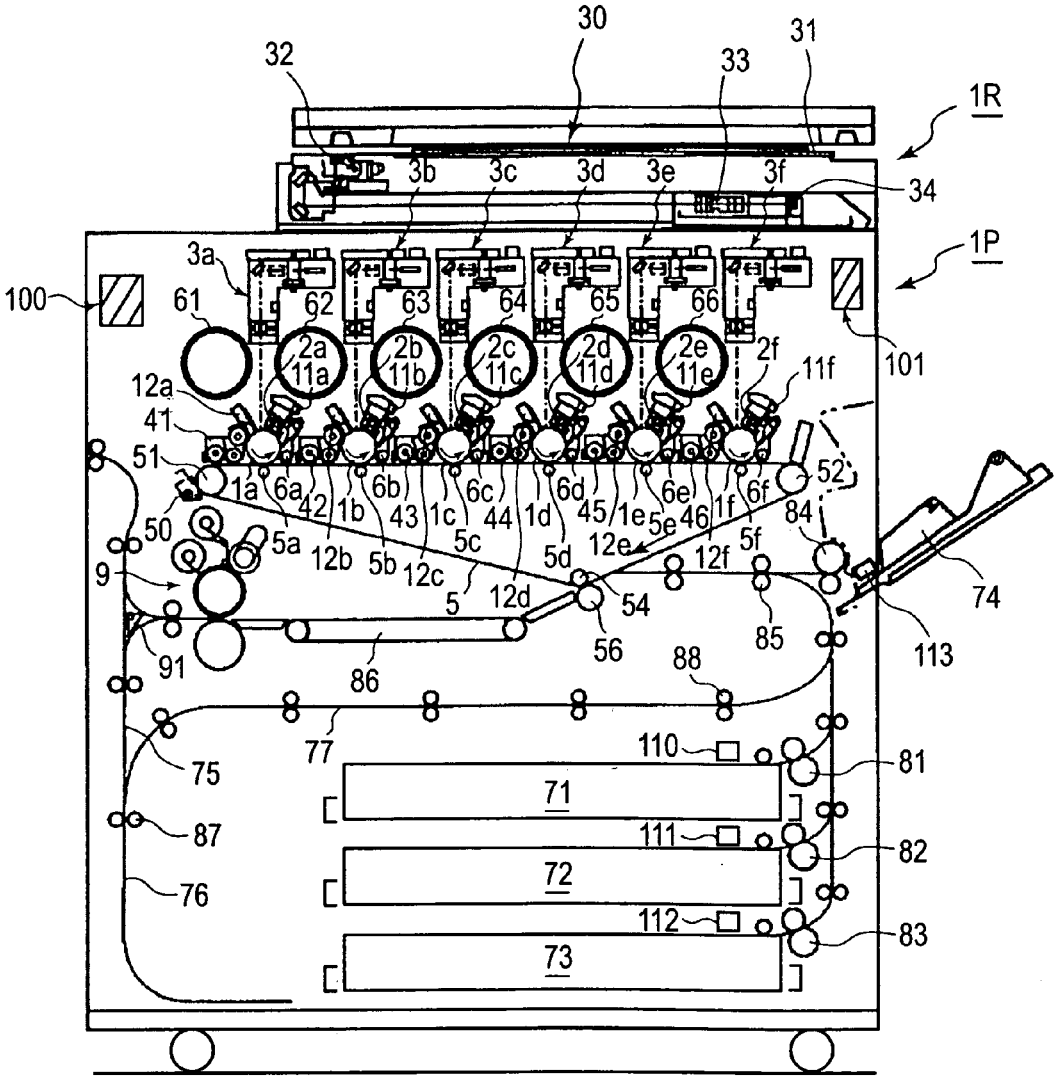
FIG. 14 is a schematic sectional view of the full-color image forming apparatus in the second embodiment of the present invention.

FIG. 14 is a schematic sectional view of the image forming apparatus in another embodiment of the present invention, showing the general structure thereof. The image forming apparatus in this embodiment is of a tandem type having six image bearing members 1*a*, 1*b*, 1*c*, 1*d*, 1*e*, and 1*f*.

The components, members, portions, etc., of this image forming apparatus, identical in function to those of the image forming apparatus in the first embodiment, will be given the same referential numbers as those given in the first embodiment. Next, the structure of this image forming apparatus will be described.

Referring to FIG. 14, the image forming apparatus has six developing apparatuses, and six photosensitive drums as image bearing members.

In other words, the image forming apparatus in this embodiment is a full-color image forming apparatus. It comprises a digital color image reader 1R, which is located in the top portion of the apparatus, and a digital color image printing station 1P, which is in the bottom portion of the apparatus.

The image forming operation of this apparatus is as follows. That is, an original 30 is placed on the original placement glass platen 31 of the reader portion 1R, and the original 30 is scanned by an exposure lamp 32 so that the light reflected by the original 30 is focused onto the full-color CCD sensor 34 by a lens 33. As a result, electrical signals (video signals) representing color components of the original 30 are obtained. These video signals are amplified by an unshown amplification circuit, and then, are sent to an unshown video processing unit, in which the signals are processed. Then, they are sent to the printing station 1P by way of an unshown image formation data storage.

To the printing station 1P, not only the signals from the reader portion 1R are sent, but also, the video signals from a computer, video signals from a facsimile machine, etc., are sent. However, the image forming operation of the image formation station 1P will be described assuming that video signals are sent from the reader portion 1R.

The printing station 1P comprises: the six photosensitive drums 1 (1*a*, 1*b*, 1*c*, 1*d*, 1*e*, and 1*f*) as image bearing members; six pre-exposure lamps 11 (11*a*, 11*b*, 11*c*, 11*d*, 11*e*, and 11*f*); six primary charging devices 2 (2*a*, 2*b*, 2*c*, 2*d*, 2*e*, and 2*f*) of a corona discharge type; six laser based exposure optical systems 3 (3*a*, 3*b*, 3*c*, 3*d*, 3*e*, and 3*f*); six potential level sensors 12 (12*a*, 12*b*, 12*c*, 12*d*, 12*e*, and 12*f*); six developing apparatuses (41, 42, 43, 44, 45, and 46) containing six toners different in spectral characteristic, one for one; six transferring apparatuses (5*a*, 5*b*, 5*c*, 5*d*, 5*e*, and 5*f*); and six cleaning devices 6 (6*a*, 6*b*, 6*c*, 6*d*, 6*e*, and 6*f*. The six photosensitive drums 1 (1*a*, 1*b*, 1*c*, 1*d*, 1*e*, and 1*f*) are rotatable supported so that they can be rotated in the direction indicated in the drawing, and the other components are disposed in the adjacencies of the peripheral surfaces of the corresponding photosensitive drums 1 (1*a*, 1*b*, 1*c*, 1*d*, 1*e*, and 1*f*), in a manner to surround the photosensitive drums 1 (1*a*, 1*b*, 1*c*, 1*d*, 1*e*, and 1*f*), one for one.

In this embodiment, the six image bearing members 1 (1*a*, 1*b*, 1*c*, 1*d*, 1*e*, and 1*f*), and the six pre-exposure lamps 11, six primary charging devices 2 of a corona discharge type, six laser based exposure optical systems 3, six potential level sensors 12, six developing apparatuses 40, six transferring apparatus (5*a*, 5*b*, 5*c*, 5*d*, 5*e*, and 5*f*), and six cleaning devices 6, which are located in the adjacencies of the peripheral surfaces of the six image bearing members 1, one for one, in a manner to surround the image bearing members 1, make up six image formation stations. However, the number of the image formation stations does not need to be limited to six. It may be any number no less than four.

The developing apparatuses 41–46 are filled with low color density magenta toner (LM), low color density cyan toner (C), yellow toner (Y), magenta toner (M), cyan toner (C), and black toner (K), respectively.

The developing apparatuses 41–46 in this embodiment contain two-component developer, or the mixture of toner and carrier. However, they may contain single-component developer. The employment of such developing apparatuses does not create any problem. In this embodiment, the same developers as those in the first embodiment, that is, magenta toner (M), cyan toner (C), yellow toner (Y), low color density magenta toner (LM), low color density cyan toner (LC), and black toner (K), are used.

The video signals sent from the reader portion 1R are converted into optical signals by the laser based exposure optical systems, that is, scanners 3 (3*a*, 3*b*, 3*c*, 3*d*, 3*e*, and 3*f*). The optical signals, that is, the beams of laser light modulated with the video signals, are deflected (reflected) by the polygon mirror, transmitted through the lens, deflected (reflected) by multiple mirrors, and then, are projected onto the peripheral surfaces of the photosensitive drums 1 (1*a*, 1*b*, 1*c*, 1*d*, 1*e*, and 1*f*).

When the image formation stations 1P of the printer are in operation, the photosensitive drum 1 (1*a*, 1*b*, 1*c*, 1*d*, 1*e*, and 1*f*) is rotated in the direction indicated by an arrow mark. in terms of the image formation sequence, first, an electrical charge is removed from the photosensitive drum 1 (1*a*, 1*b*, 1*c*, 1*d*, 1*e*, and 1*f*) by the pre-exposure lamp 11 (11*a*, 11*b*, 11*c*, 11*d*, 11*e*, and 11*f*). Then, the photosensitive drum 1 (1*a*, 1*b*, 1*c*, 1*d*, 1*e*, and 1*f*) is uniformly charged by the primary charging device 2 (2*a*, 2*b*, 2*c*, 2*d*, 2*e*, and 2*f*), and is exposed to the exposure light corresponding to a specific toner among the aforementioned six toners. As a result, an electrostatic image is formed on the peripheral surface of the photosensitive drum 1 (1*a*, 1*b*, 1*c*, 1*d*, 1*e*, and 1*f*). The above-described steps are carried out for each of the color components into which an intended image is separated.

Next, the developing apparatuses 41, 42, 43, 44, 45, and 46 are made to operate to develop the latent images on the peripheral surfaces of the photosensitive drums 1 (1*a*, 1*b*, 1*c*, 1*d*, 1*e*, and 1*f*) into visible images (images formed of toner composed essentially of resin and pigment).

Referring to FIG. 14, each developing apparatus is supplied with toner from one of toner storage portions 61–66 (hoppers) with a predetermined timing so that the toner ratio (or amount of toner) in the developing apparatus remains constant. The toner storage portions 61–66 are located immediately next to the laser based exposure optical systems 3.

The toner images having been formed on the photosensitive drums 1 (1*a*, 1*b*, 1*c*, 1*d*, 1*e*, and 1*f*) are sequentially transferred in layers (primary transfer) onto an intermediary transfer belt 5 as an intermediary transferring member, by the transferring apparatuses (5*a*, 5*b*, 5*c*, 5*d*, 5*e*, and 5*f*).

The intermediary transfer belt 5 is stretched around the driver roller 51, follower roller 52, and roller 54, and is driven by the driver roller 51. On the opposite side of the intermediary transfer belt 5 from the driver roller 51, a transfer belt cleaning apparatus 50 is located, which can be placed in contact with, or separated from, the intermediary transfer belt 50.

After the necessary number of monochromatic toner images different in color are transferred in layers onto the intermediary transfer belt 5, the transfer belt cleaning apparatus 50 is pressed against the driver roller 51 to remove the toner remaining on the intermediary transfer belt 5 after the transfer of the toner images from the intermediary transfer belt 5 onto a recording medium.

Meanwhile, from one of the recording medium storage portions 71, 72, and 73, or a manual feeding portion 74, recording mediums are conveyed, one by one, by one of the recording medium feeding means 81, 82, 83, and 84, respectively, to a pair of registration rollers 85, by which the recording mediums are straightened if they are askew, and are released with a predetermined timing to be delivered to a secondary transfer station 56, in which the toner images on the intermediary transfer belt 5 are transferred onto one of the recording mediums.

After the toner images are transferred onto the recording medium in the secondary transfer station 56, the recording medium is conveyed to a fixing apparatus 9 of a thermal roller type by way of a recording medium conveying portion 86. In the fixing apparatus 9, the toner images are fixed, and then, the recording medium is discharged into a delivery tray or a post-processing apparatus.

After the secondary transfer of the toner images, the toner remaining on the intermediary transfer belt 5 is removed by the transfer belt cleaning apparatus 50, and then, the intermediary transfer belt 5 is used again for the primary transfer process carried out in each of the image formation stations.

The operation for forming an image on both surfaces of a recording medium is as follows. Immediately after the transfer medium is passed through the fixing apparatus 9, the conveyance path guide 91 is driven, temporarily guiding the transfer medium into the reversing path 76 through the recording medium conveyance path 75. Then, the pair of reversing rollers 87 are rotated in reverse, conveying backward the transfer medium, that is, conveying the transfer medium in the direction opposite to the direction in which the transfer medium is guided into the reversing path 76, in other words, the end of the transfer medium, which was trailing when the transfer medium was guided into the reversing path 76, becomes the leading end. As a result, the transfer medium is moved into the two-sided print mode path 77. Thereafter, the transfer medium is conveyed by the pair of two-sided print mode rollers 88 to the aforementioned pair of registration rollers 85 through the two-sided print mode path 77. Then, it is straightened by the registration rollers 85 if it is askew, and is released with the predetermined timing, so that an image is transferred through the above-described image formation process, on the opposite surface of the transfer medium from the surface on which an image has been already formed.

As described above, the image forming apparatus in this embodiment forms an image by carrying out virtually the same image formation process as that carried out by the image forming apparatus in the first embodiment shown in FIG. 1.

Also in this embodiment, all the recording medium feeding means 71–74 are provided with recording paper glossiness level detecting apparatuses 110–113, respectively, which detect the glossiness level of the recording mediums as the recording mediums are sent out of the recording medium feeding means 71–74, respectively, and feed back the detected glossiness level of the recording mediums to the image formation conditions, which will be described later. Obviously, the instruction regarding the glossiness level of recording medium may be manually inputted by a user as in the first embodiment.

It will be described next how the image forming apparatus in this embodiment is controlled when it is operated in the various modes regarding glossiness.

As will be evident from FIG. 12 which is the flowchart for the image forming apparatus in this embodiment, the image forming apparatus in this embodiment is enabled to operate in three different modes regarding glossiness, that is, low gloss mode, medium gloss mode, and high gloss mode, which are different in glossiness level. The switching among the three modes is made by the laser output portion 100.

More specifically, the video signals representing R, G, B, and the like colors, are converted in color into C (cyan), M (magenta), Y (yellow), and K (black). Then, the resultant video signals representing C, M, Y, and K, are processed according to one of the three glossiness modes; the resultant video signals are apportioned with reference to one of the LUTs, corresponding to the selected glossiness mode (video signal apportionment process based on LUT). Then, a set of video signals apportioned to high color density toner, and a set of video signals apportioned to low color density toner are put through the gamma correction process, and used for driving the laser drivers to output an image.

Figure 4:
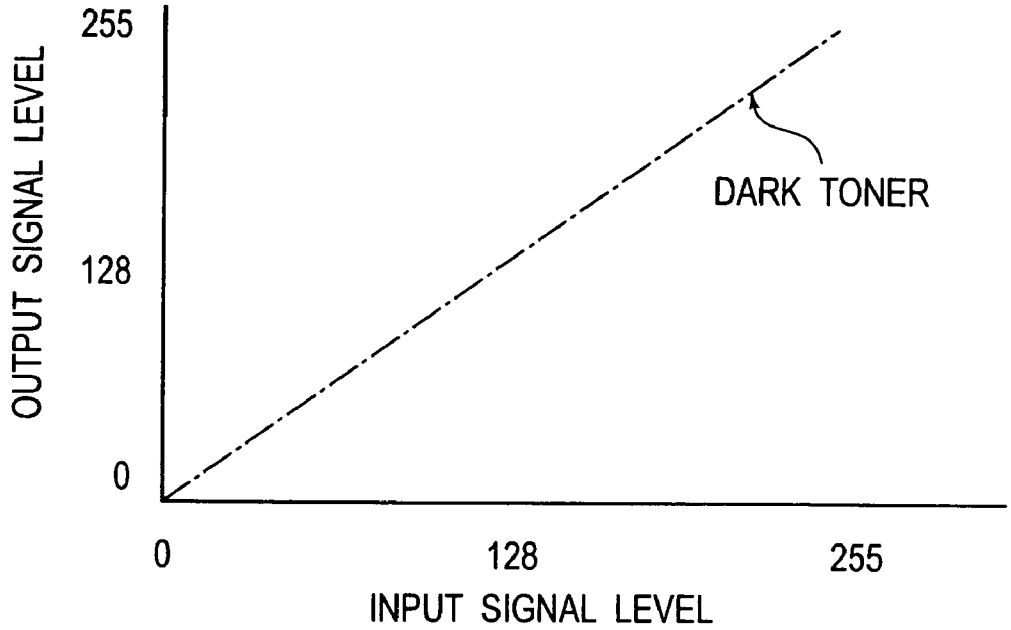
FIG. 4 is a graph showing the pattern of the look-up table (LUT) for the low gloss paper mode in the first embodiment.
Figure 15:
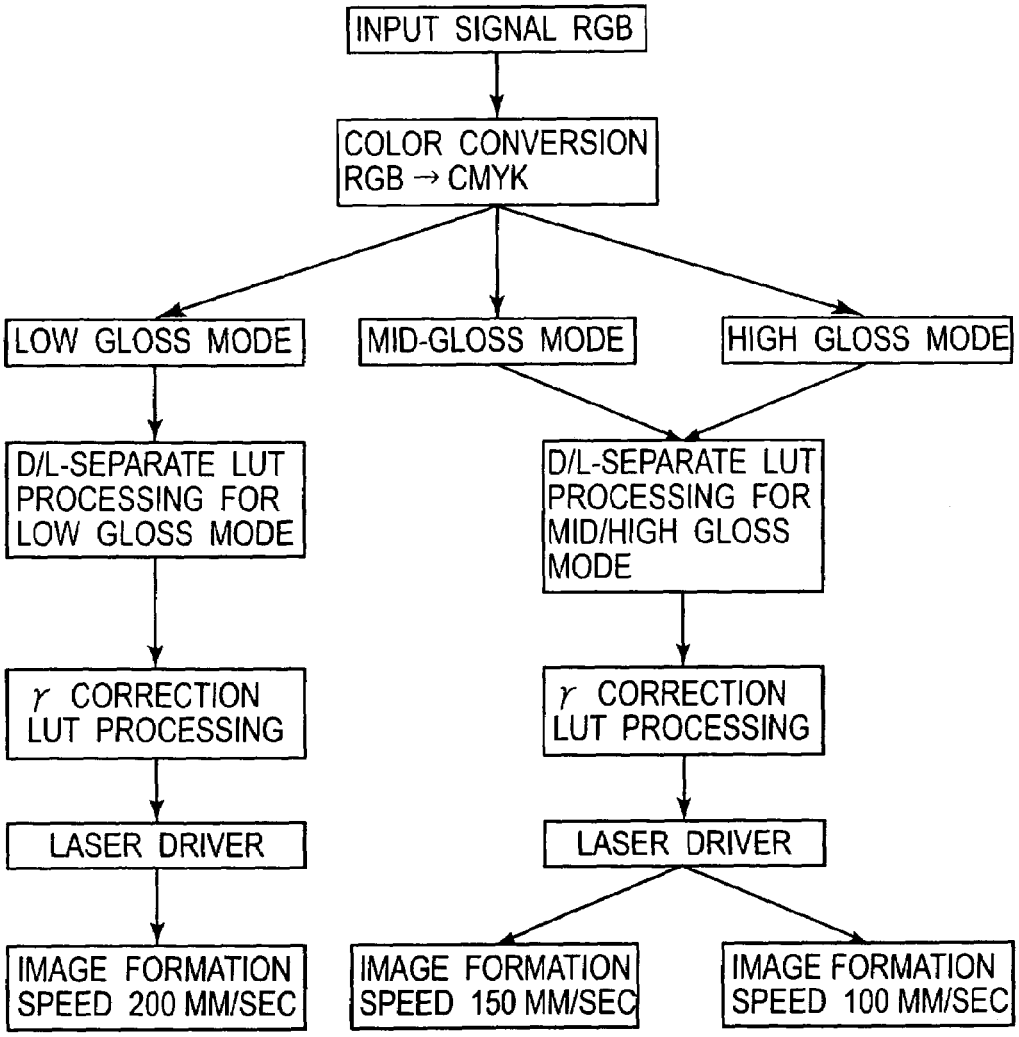
FIG. 15 is a flowchart for controlling the image forming apparatus in the second embodiment of the present invention.

To be described further, referring to FIG. 15, in this embodiment, one of the image formation modes is the low gloss mode which is expected to be used for forming an image on high quality paper or the like, which is low in glossiness level, and a second image formation mode is the medium gloss mode which is expected to be used for forming an image on a recording medium, the glossiness level of which is no more than 40. A third image formation mode is the high gloss mode which is expected to be used for forming an image on a recording medium, the glossiness level of which is no less than 40. As for the video signal apportionment LUT used in this embodiment, when in the low gloss mode, the LUT in FIG. 4 is used, whereas when in medium and whereas when in medium and high gloss mode, the LUT in FIG. 5 is used.

Next, it will be described how the operational speed of the image forming apparatus is controlled in each of the aforementioned three modes.

Referring to FIG. 15, when in the standard low gloss mode, the image forming apparatus is operated at 200 mm/sec. However, the glossiness level achievable by operating the apparatus at this speed is roughly no more than 20, being rather low. Thus, in this embodiment, the operational speed of the image forming apparatus, or at least, the fixation speed, is varied according to the selected gloss level mode. That is, when in medium gloss mode, the fixating apparatus is operated at 150 mm/sec, and when in high gloss mode, the fixing apparatus is operated at 100 mm/sec.

Figure 16:
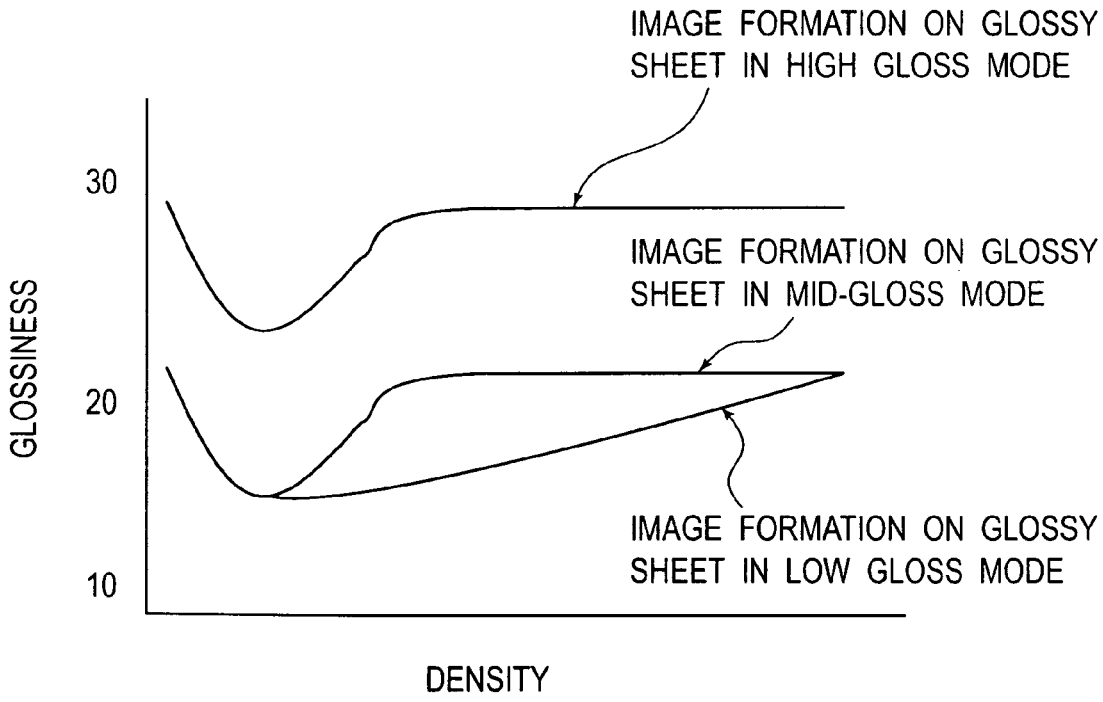
FIG. 16 is a graph showing the relationship between the color density level and the glossiness level achieved when an image is formed on a high gloss paper by operating the image forming apparatus in the second embodiment in the high, medium and low gloss modes.

When the image forming apparatus is structured as described above, the glossiness characteristic in each mode becomes as shown in FIG. 16; it is optimized. This means that the glossiness level is substantially affected by the fixation speed.

Generally, the operational speed of an image forming apparatus, or the operational speed of at least the fixing apparatus thereof, is varied according to the thickness of a recording medium on which an image is formed. This control is also carried out in the case of this image forming apparatus. For example, when recording paper, the weight of which is no less than 150 g/m$^2$, is used, the optimal image formation speed in the standard low gloss mode is 100 mm/sec. Therefore, when in the medium and high gloss modes, the image formation speed is set to 75 mm/sec, and 50 mm/sec, respectively.

As described above, in this embodiment, the image formation mode is switched according to the detected glossiness level of the recording medium. Further, also according to the detected glossiness level of the recording medium, the ratio at which the video signals are apportioned among the high and low color density toners, and also, the image formation speed (at least fixation speed) is controlled. Therefore, it is possible to form such an image that best matches the glossiness level of recording medium.

Figure 17:
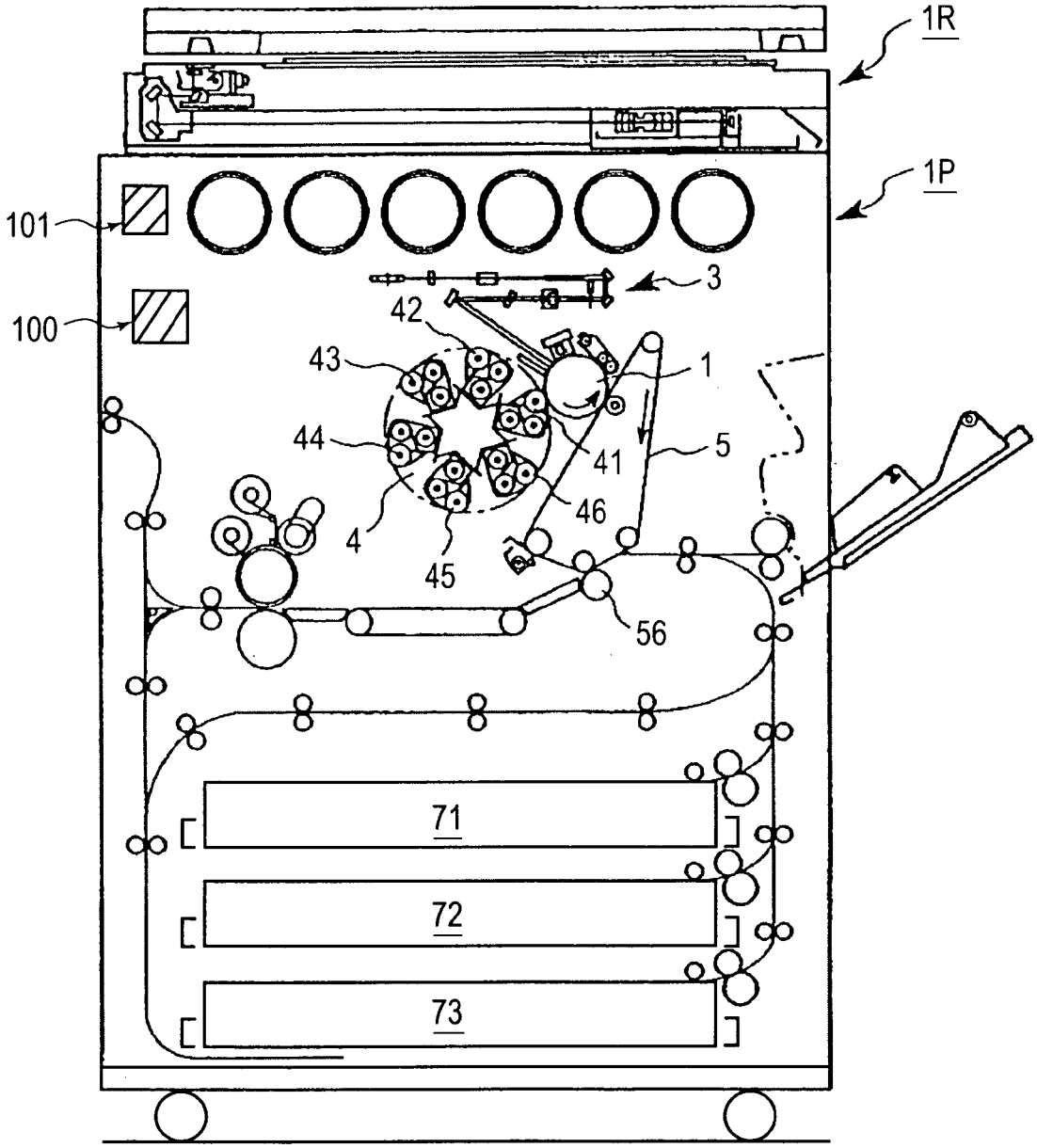
FIG. 17 is a schematic sectional view of an image forming apparatus which uses six toners different in hue or color density, showing the general structure thereof.
Figure 18:
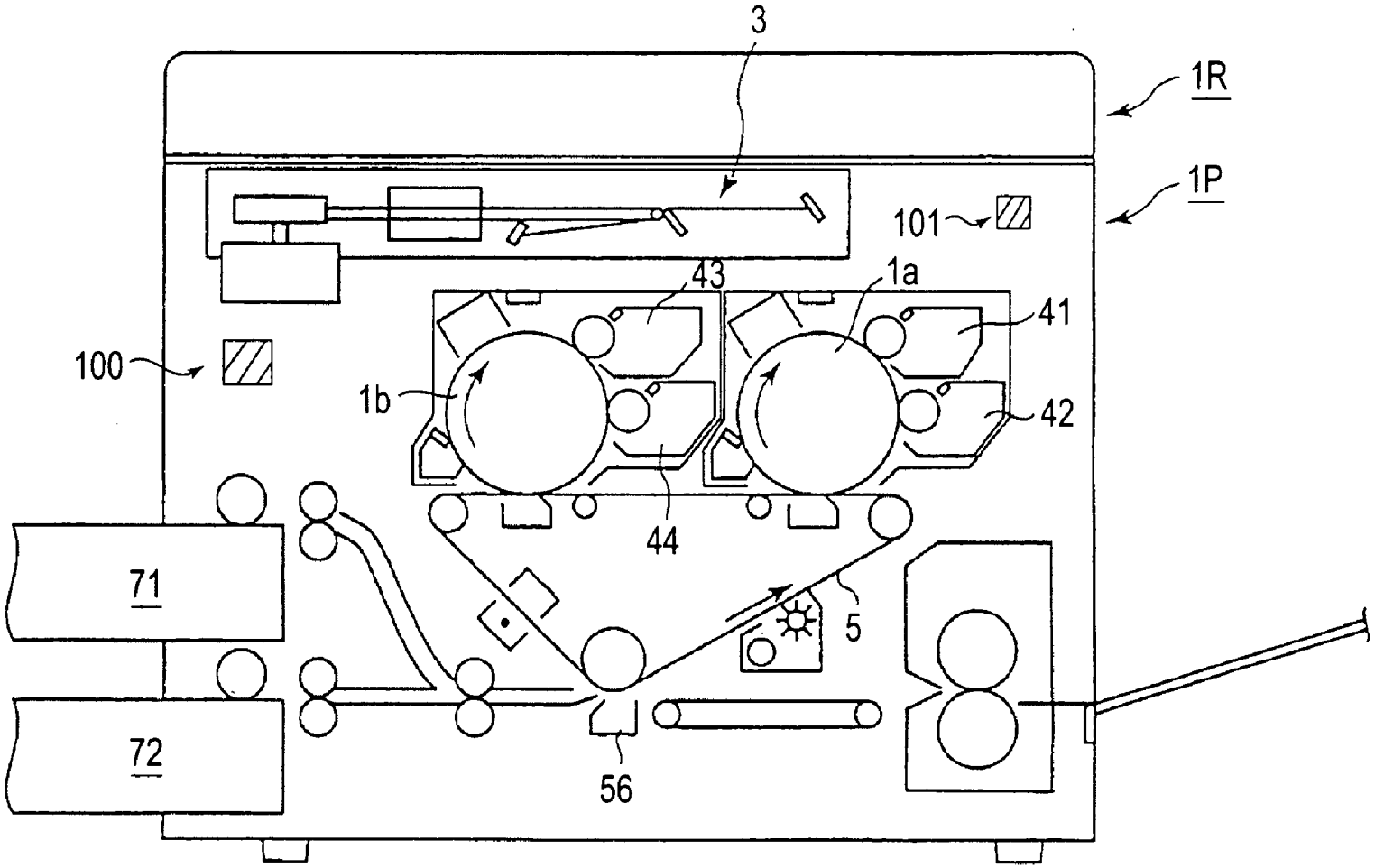
FIG. 18 is a schematic sectional view of an image forming apparatus which uses four toners different in hue or color density and employs two photosensitive drums to accomplish the same effects as those accomplished by the image forming apparatus in FIG. 17, showing the general structure thereof.

Although, in the above-described embodiments 1 and 2, of the present invention, the image forming apparatuses were structured as shown in FIG. 1 or 14, the present invention is also applicable to the image forming apparatuses structured as shown in FIGS. 17 and 18, and the effects attainable by such applications are the same as those attained in the image forming apparatuses in the embodiments 1 and 2.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 204677/2003 filed on Jul. 31, 2003, which is hereby incorporated by reference.

What is claimed is:

1. An image forming apparatus comprising:

an image bearing member for carrying an electrostatic image;

developing means for developing the electrostatic image with toners having the same hue and having different densities;

toner image formation means for forming a toner image on a recording material; and fixing means for fixing the toner image on the recording material, wherein a ratio of amounts of toners having the same hue and different densities, which constitute the toner image is changed on the basis of a glossiness of the recording material.

2. An apparatus according to claim 1, wherein the ratio changes on the basis of a density of the toner image fixed on the recording material.

3. An apparatus according to claim 1 or 2, wherein said image forming apparatus includes the toners having the same hue and different densities, and wherein the ratio of the low density toner having the same hue increases with an increase of the glossiness of the recording material.

4. An apparatus according to claim 1, further comprising mode selecting means for selecting between a first mode in which the toner image is formed only by a highest density toner among the toners having the same hue and different densities, and a second mode in which the toner image is formed by toners having the same hue and different densities, wherein said selecting means selects a mode on the basis of a glossiness of the recording material.

5. An apparatus according to claim 4, wherein said selecting means selects the first mode when the glossiness of the recording material is less than a predetermined value, and said selecting means selects the second mode when the glossiness of the recording material is not less than a predetermined value.

6. An apparatus according to claim 5, wherein in a toner image formed in the second mode, a total of amounts per unit area of the toners which have the same hue and different densities and which constitute a part of the toner image, is substantially the same as a total of amounts per unit area of the toners which have the same hue and different densities and which constitute another part of the toner image having a different density.

7. An apparatus according to claim 6, wherein the toners having the same hue and different densities are controlled by individual look-up tables when the toner image is formed in the second mode.

8. An apparatus according to claim 4, wherein in a portion of the toner image formed in the second mode formation and having a density higher than a predetermined level, and wherein a total amount of the toners having the same hue and different densities is substantially constant.

9. An apparatus according to claim 8, wherein said selecting means selects the first mode when the glossiness of the recording material is less than a predetermined value, and said selecting means selects the second mode when the glossiness of the recording material is not less than a predetermined value.

10. An apparatus according to claim 9, wherein the toners having the same hue and different densities are controlled by individual look-up tables when the toner image is formed in the second mode.

11. An apparatus according to claim 10, wherein the portion having the density higher than the predetermined level is constituted by toner having Nth high density and toner having (N+1)th high density, where N is an integer.

12. An apparatus according to claim 11, wherein an optical density D (n), after image fixing, of the toner image formed with a predetermined amount of an Nth high density, and wherein an optical density D (n+1), after image fixing, of the toner image formed with a predetermined amount of an (N+1)th high density on the recording material satisfies the following condition:

$$D(n+1)=(1/2)D(n).$$

* * * * *

UNITED STATES PATENT AND TRADEMARK OFFICE

CERTIFICATE OF CORRECTION

PATENT NO. : 7,110,686 B2
APPLICATION NO. : 10/902074
DATED : September 19, 2006
INVENTOR(S) : Yuichiro Toyohara It is certified that error appears in the above-identified patent and that said Letters Patent is hereby corrected as shown below:

COLUMN 1:
Line 50, “the” should read --that--.
Line 57, “an” should read --a--.

COLUMN 5:
Line 37, “tone” should read --toner--.

COLUMN 7:
Line 17, “be” should be deleted.

COLUMN 18:
Lines 13, “wherein” should be deleted.
Line 33, “wherein” should be deleted.

Signed and Sealed this

First Day of May, 2007

JON W. DUDAS
*Director of the United States Patent and Trademark Office*